US006014874A

United States Patent [19]

Shima et al.

[11] Patent Number: 6,014,874

[45] Date of Patent: Jan. 18, 2000

[54] YARN GUIDE FOR WEFT KNITTING MACHINE

[75] Inventors: Masahiro Shima; Minoru Sonomura, both of Wakayama, Japan

[73] Assignee: Shima Seika Mfg., Ltd., Wakayama-shi, Japan

[21] Appl. No.: 08/981,633

[22] PCT Filed: May 15, 1997

[86] PCT No.: PCT/JP97/01628

§ 371 Date: Sep. 15, 1998

§ 102(e) Date: Sep. 15, 1998

[87] PCT Pub. No.: WO97/43477

PCT Pub. Date: Nov. 20, 1997

[30] Foreign Application Priority Data

May 15, 1996 [JP] Japan ..... 8-144984
May 13, 1997 [JP] Japan ..... 9-139429

[51] Int. Cl.[7] ..... D04B 15/06

[52] U.S. Cl. ..... 66/106; 66/64; 66/109

[58] Field of Search ..... 66/106, 90, 64, 66/60 R, 104, 109

[56] References Cited

U.S. PATENT DOCUMENTS 5,305,618 4/1994 Yabuta ..... 66/64
5,333,473 8/1994 Miyamoto ..... 66/64
5,557,948 9/1996 Shima et al. .

FOREIGN PATENT DOCUMENTS 0 672 769 A1 3/1995 European Pat. Off. .
7-258946 9/1995 Japan .
8-13293 1/1996 Japan .

*Primary Examiner*—John J. Calvert
*Assistant Examiner*—Larry D. Worrell, Jr.
*Attorney, Agent, or Firm*—Armstrong, Westerman, Hattori, McLeland & Naughton

[57] ABSTRACT

An apparatus for guiding yarn into a hook or to a predetermined position of a rear face of a needle of a flat knitting machine, and for guiding the yarn without making large horizontal advancing and retracting movements of a yarn guiding member of the yarn guiding apparatus. The apparatus guides the yarn, when a yarn pushing down operating edge at an end of the yarn guide member is engaged with and pushes down the yarn so that the yarn is slidably moved, without applying a high resistance to the yarn and parallel needles and sinkers, on at least one pair of needle beds having head portions opposed to each other with respect to the center of knock-over edge portions. Yarn holding members, each having a yarn pushing down edge operating at an end thereof, are supported for sliding movement toward the knock-over edge portion, with means for moving each of the yarn pushing down operating edges downward during or after sliding advancement of the yarn holding member.

8 Claims, 17 Drawing Sheets

21
27
6
3
7
9
13
17
31
32
35
36
37
37L
37H
38
39
40
41
30
45
46
48
43
44
100
101
102
103
105
107
108
109
110
111
112
113
114
115
116
117
118

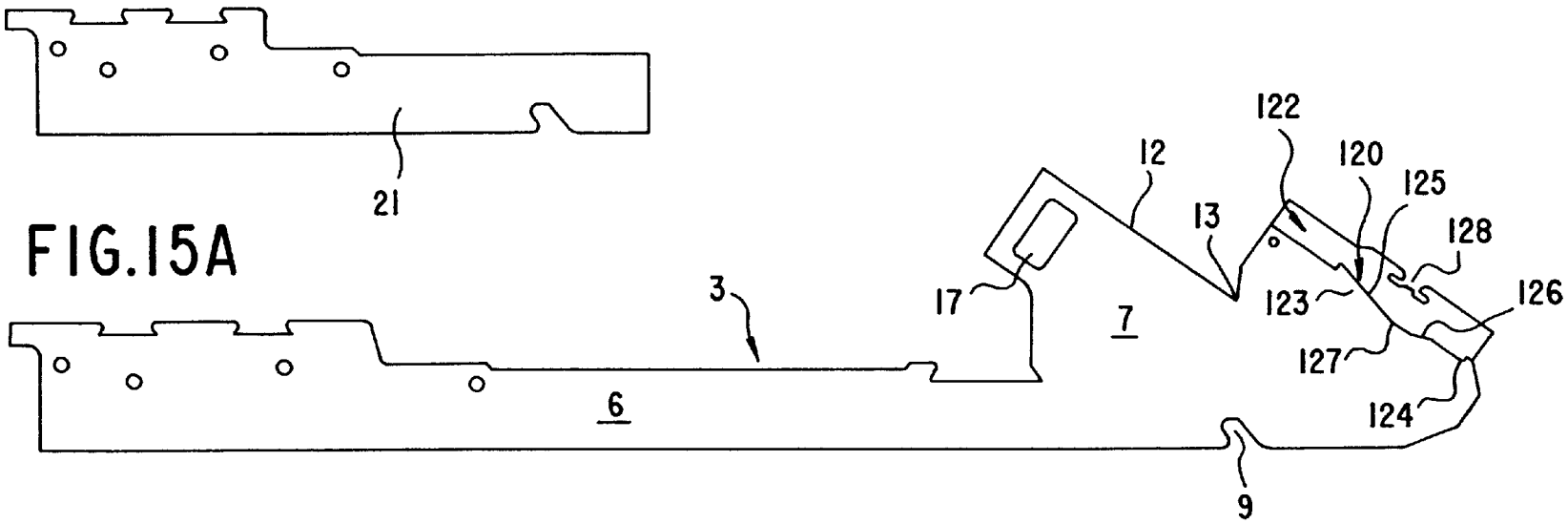
FIG.15B
FIG.15A
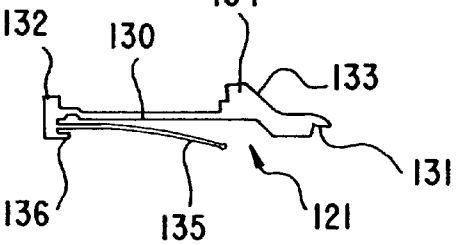
FIG.15C
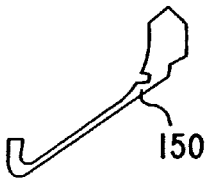
FIG.15D
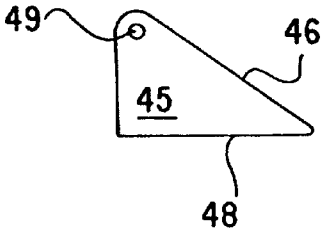
FIG.15E

YARN GUIDE FOR WEFT KNITTING MACHINE

TECHNICAL FIELD

This invention relates to a yarn guiding apparatus for guiding a yarn supplied to a needle of a flat knitting machine to a predetermined position on the front face or the rear face of the needle.

BACKGROUND ART

A yarn guiding apparatus wherein yarn holding members, each having a pushing down edge at an end portion thereof for pushing down a yarn, are provided for advancing and retreating movements between a plurality of needles and sinkers provided in rows such that, when each of the yarn holding members is advanced, such yarn holding member can be engaged with a yarn being supplied to a needle from a yarn carrier or already knitted and extending between needles and positioned, when a needle is advanced, such yarn into a hook or to the rear face of the needle developed by the applicant of the present application and disclosed in Japanese Patent Laid-Open No. Hei 8-13293.

However, where such a yarn holding member, as disclosed in the specification mentioned above, is itself moved forwardly and backwardly, in a horizontal direction, to engage a yarn pushing down operating edge, provided obliquely at an end thereof with a yarn to push down the yarn to a predetermined position, a sliding resistance is produced, between them and unnecessary tension is applied to the yarn. In order to push down the yarn to the predetermined position, it is necessary to either make the stroke of the yarn holding member large, or make the inclination angle large, to make the pushed down amount of the yarn large. However, if the latter is adopted, in order to make the knitting machine compact, then the inclination angle of the yarn pushing down acting edge must be made large, and a high resistance is applied to the yarn, when the yarn is pushed down. Further, the yarn which is engaged with the operating edges of left and right yarn holding members is pushed down in a condition bent in a zigzag condition while the yarn is kept taut. Consequently, in such a situation, the yarn is kept in a position higher than the aimed pushed down position and cannot be pushed down to the aimed position. This is likely to occur where a yarn does not slip well or when the knitting speed is high. Therefore, it is desired to prevent a high sliding resistance from being supplied to a yarn, when the yarn guide member pushes down the yarn.

Taking the foregoing into consideration, it is an object of the present invention to provide a yarn guiding apparatus which can guide a yarn without making advancing and retreating movements of a yarn guiding member for guiding a yarn into a hook of a needle, or to the rear face of a needle in a horizontal direction large and can guide the yarn, when an operating edge at an end of the yarn guiding member is engaged with and pushes down the yarn, in such condition that the yarn is slidably moved and a high resistance is not applied to the yarn.

DISCLOSURE OF THE INVENTION

According to the present invention, parallel to needles and sinkers provided on at least one pair of needle beds, having head portions opposed to each other with respect to the center of knock-over edge portions, yarn holding members, each having a yarn pushing down operating edge at an end thereof, are supported for sliding movement toward the knock-over edge portions, and yarn holding member deflection means is provided, for moving each of the yarn pushing down operating edges downwardly during sliding advancement of the yarn holding member. Consequently, because the yarn pushing down advancing and retreating movements of the operating edge of each of the yarn holding members are a combination of movements in a horizontal direction and movements of a vertical direction, such that, the yarn pushing down operating edge is pivoted downwardly while it such operating edge moves and passes above a yarn or, after a horizontal movement, the yarn holding down operating edge first keeps a most advanced position and then is moved downwardly, when the yarn pushing down operating edge is to be engaged with and push down a yarn, the yarn pushing down operating edge acts upon the yarn contacted therewith so as to push the yarn downwardly from above. Consequently, the load acting upon the yarn is reduced, as compared with a conventional yarn guide, without making the strokes of advancing and retreating movements of the yarn holding member, and, it is possible to catch and push the yarn down with certainty without allowing the yarn to escape therefrom.

BEST MODE FOR CARRYING OUT THE INVENTION

Figure 1:
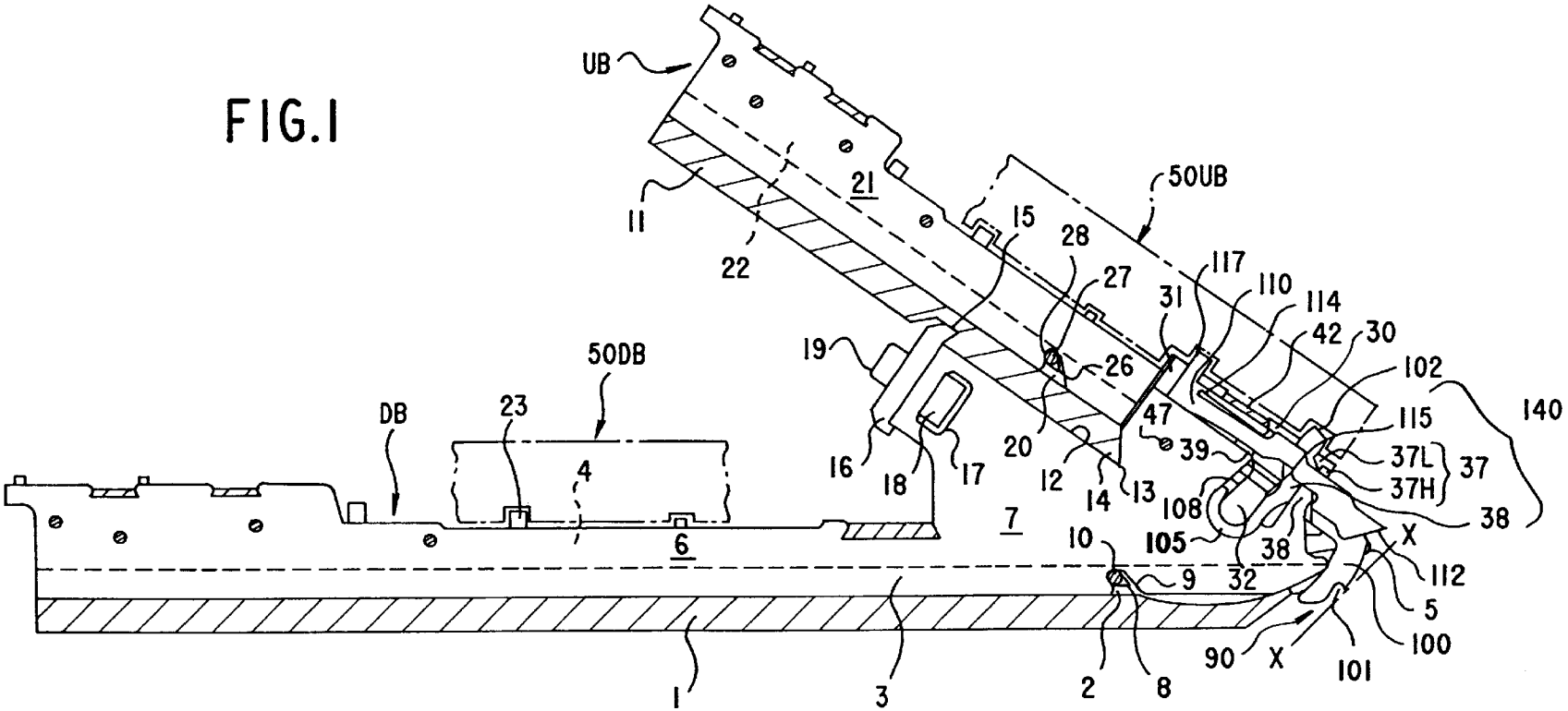
FIG. 1 is a vertical sectional side elevational view of back beds of the instant invention.
Figures 2A, 2B, 2C, 2D, 2E, 2F:
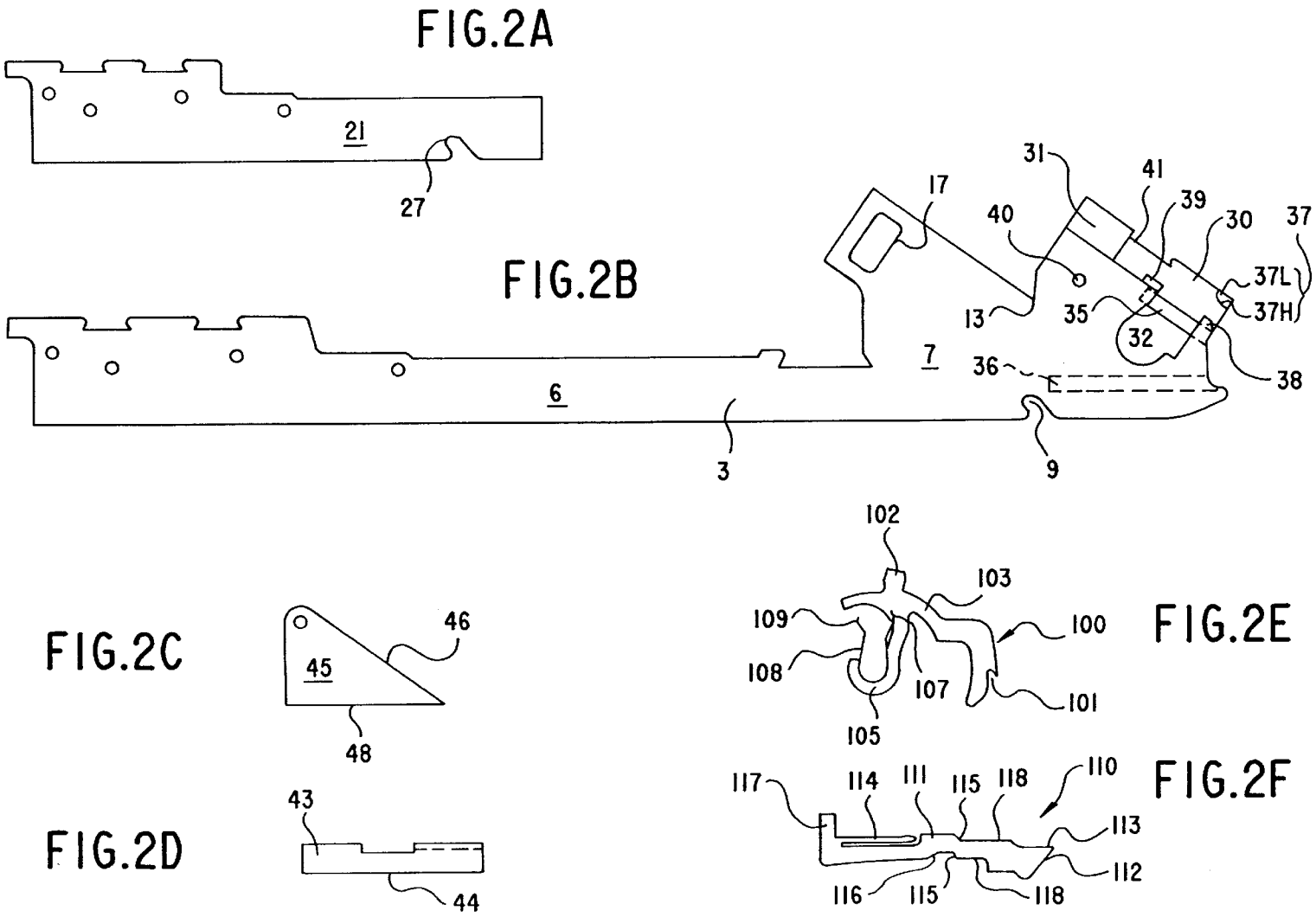
FIG. 2 are side elevational views of an upper needle plate, a lower needle plate, spacers, a sinker and a yarn holding member, respectively of such invention.
Figure 3:
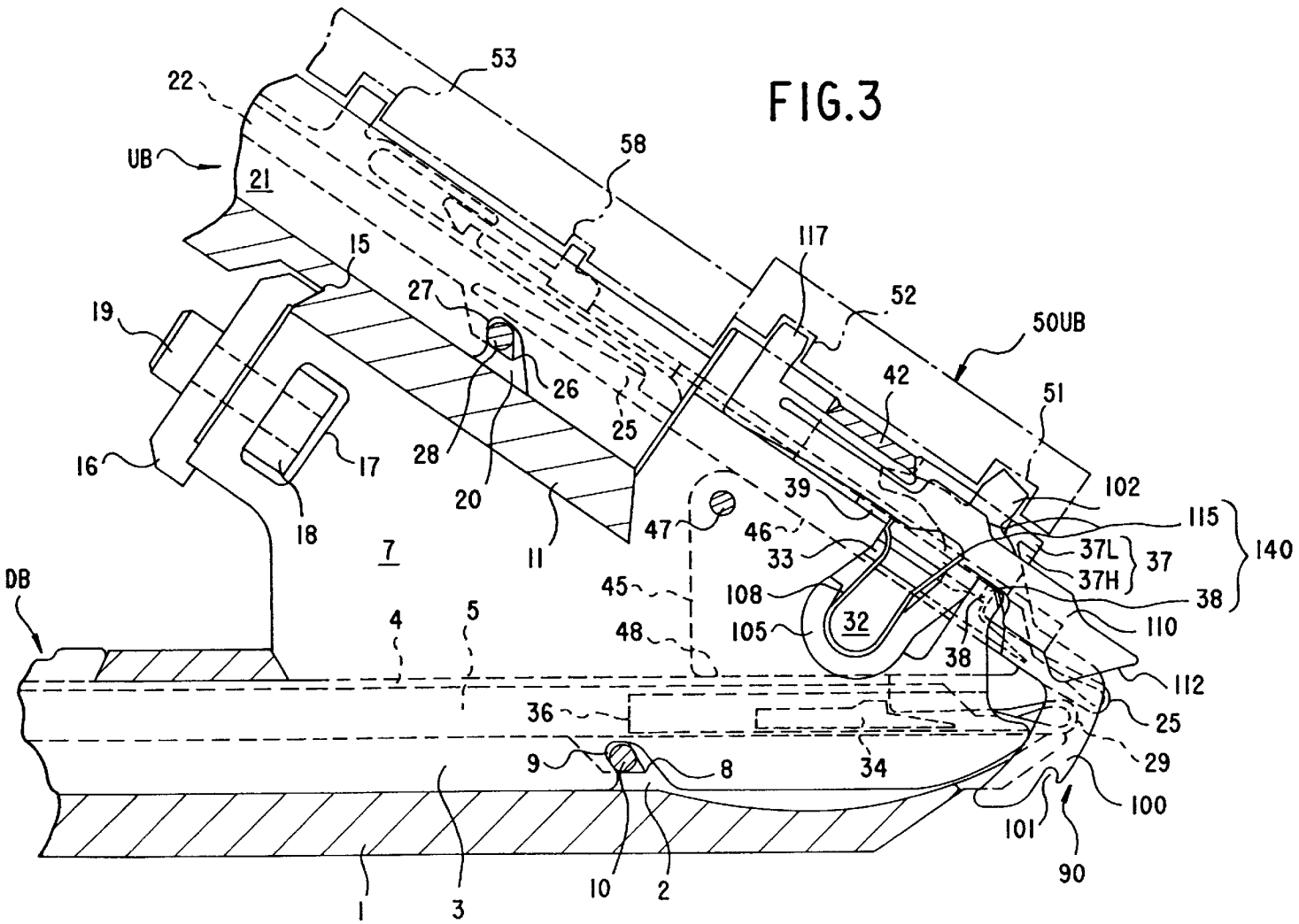
FIG. 3 is an enlarged vertical sectional side elevational view of knock-over edge portions of the back beds.
Figure 4:
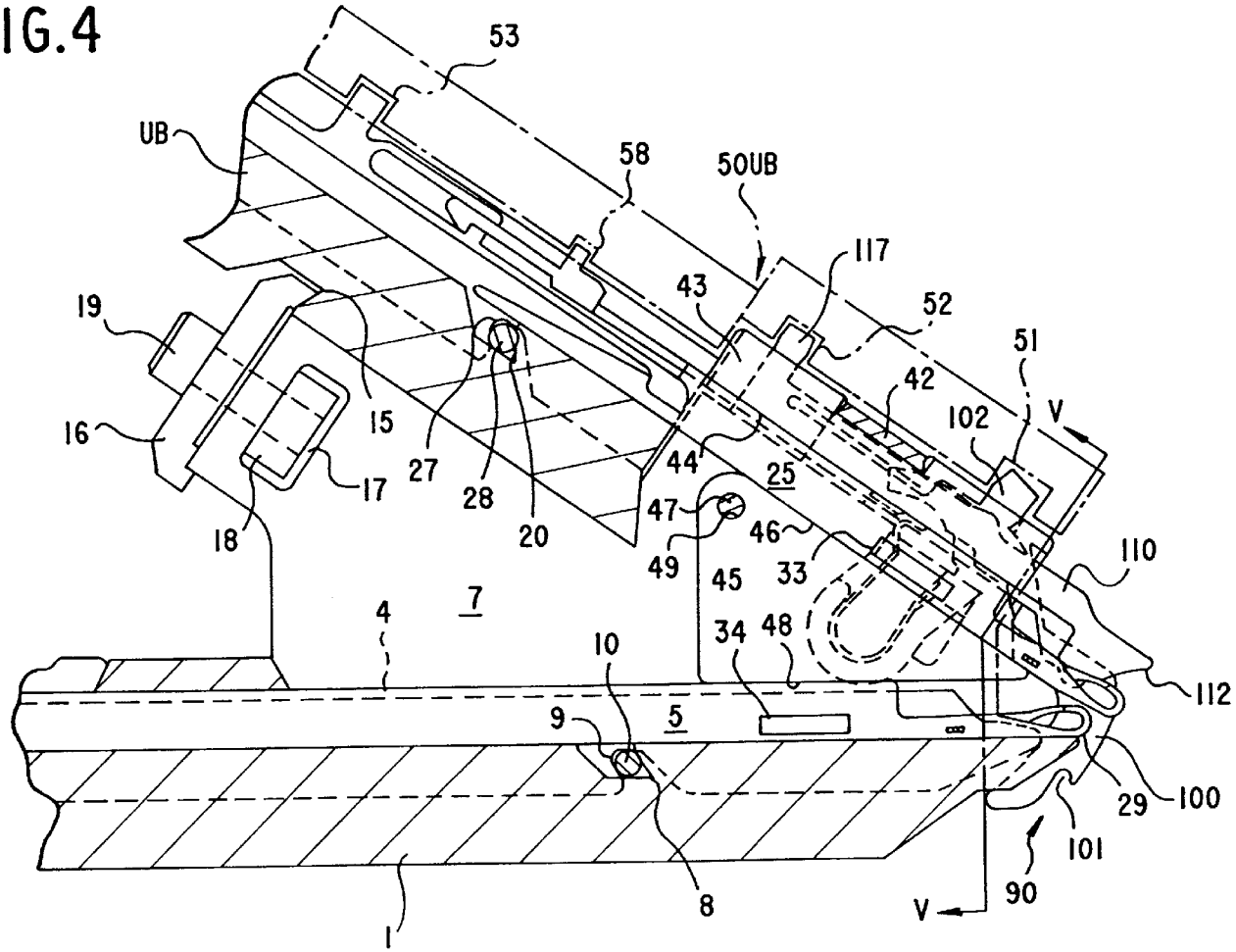
FIG. 4 is a vertical sectional side elevational view of knock-over edge portions of the back beds taken along side faces of the needle bodies.
Figure 5:
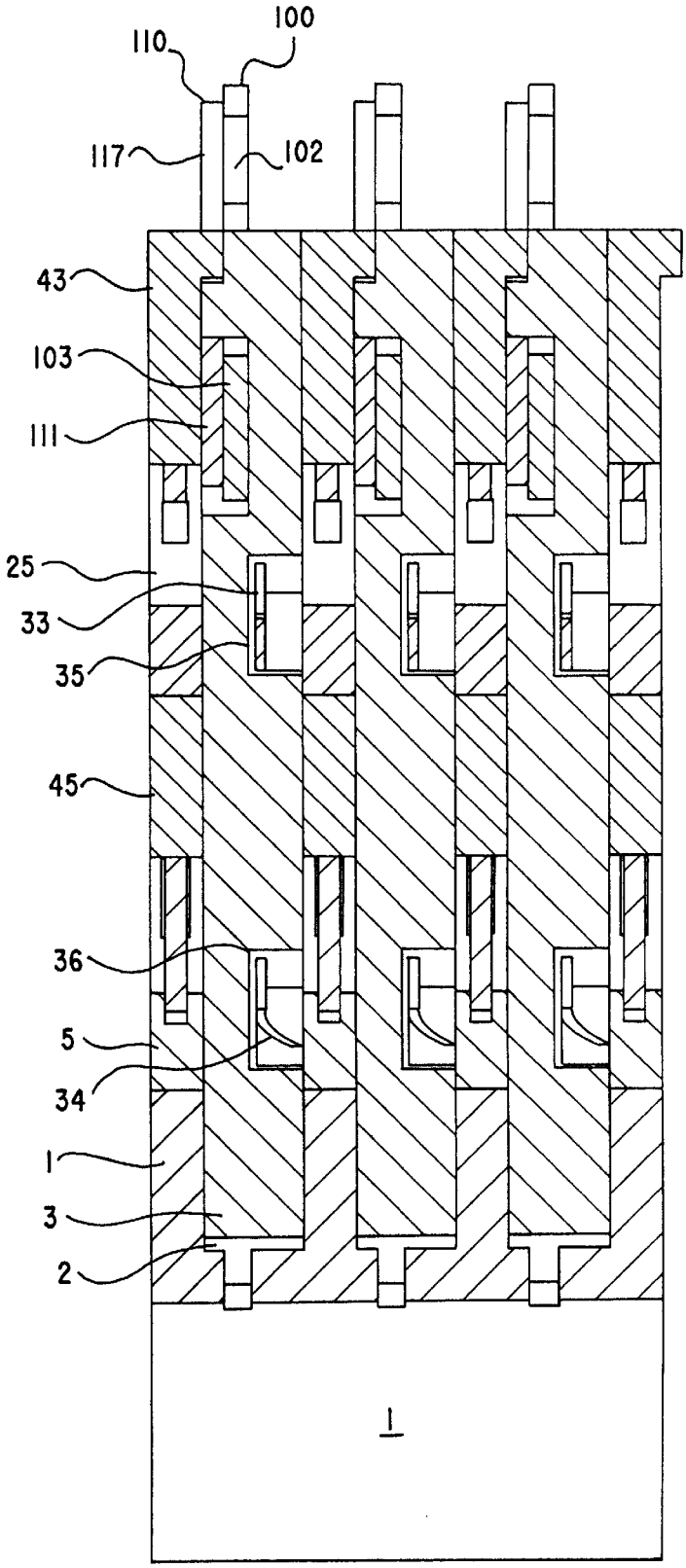
FIG. 5 is a sectional end view taken along line V—V of FIG. 4.

A first embodiment of the present invention is described below in connection with an example wherein, in a four-bed flat knitting machine which includes front and back lower beds provided with head portions thereof opposed to each other in such a manner as to exhibit a mountain shape and front and back upper beds provided in an overlapping relationship with the front and back lower beds with head portions thereof opposed to each other in such a manner as to exhibit a mountain shape, movable sinkers 100, FIGS. 1 and 2 and yarn holding members 110, FIG. 2, are provided on the upper beds UF and UB. FIG. 1 is a sectional view of the upper and lower back beds UB and DB with the upper and lower front beds UF and DF on the right side with respect to a knock-over edge center line X—X.

The lower back bed DB includes lower needle plates 3 fitted in a plurality of needle plate grooves 2 formed in parallel to each other in a lower needle bed base plate 1, and lower needles 5 inserted in needle tricks 4 formed between adjacent ones of the lower needle plates 3 and 3. Each of the lower needle plates 3 has a lower needle guide plate portion 6, and a head needle plate portion 7 formed from an expanded portion extending upwardly from a head portion of the lower needle guide plate portion 6. The lower needle bed base plate 1 and the lower needle plates 3 are formed as a unitary member by threading a wire 10 in recesses 8 and 9 formed therein, respectively, and caulking tail portions of the needle bed base plate 1 and the lower needle plates 3 to each other.

The head needle plate portions 7 have support faces 12 for supporting an upper needle bed base plate 11 thereon. The upper needle bed base plate 11 is placed on and secured to the support faces 12 by placing the upper needle bed base plate 11 on the support faces 12 with end engaging portions 14 thereof engaged with wedge-shaped recessed portions 13 at end portions of the support faces 12 and fastening a belt-like arresting member 16 extending between a recess 15 on the lower face of the upper needle bed base plate 11 and the head needle plate portions 7 of the lower needle plates 3 and extending in a knitting machine frame longitudinal direction and a securing beam 18 fitted in threading holes 17 formed in the head needle plate portion 7 to each other by means of screws 19.

Also the upper needle bed base plate 11 has a plurality of needle plate grooves 20 similarly to the lower needle bed base plate 1, and upper needle plates 21 are fitted in the needle plate grooves 20 such that needle tricks 22 are formed between adjacent ones of the upper needle plates 21, 21 and upper needles 25 are inserted in the needle tricks 22. The upper needle bed base plate 11 and the upper needle plates 21 are formed as a unitary member by threading a wire 28 in recesses 26 and 27 formed therein, respectively, and caulking tail portions of the needle bed base plate 11 and the upper needle plates 21 to each other.

The head needle plate portions 7 of the lower needle plates 3 have, at top portions thereof, sinker accommodating stepped portions 30 with an offset and yarn holding member accommodating stepped portions 31 with a smaller offset which extend in advancing and retreating directions of the upper needles 25 fitted for sliding movement in the needle tricks 22 and stepped portions 32 continuous to the sinker accommodating stepped portions 30 and extending downwardly for supporting the U-shaped sinkers 100. The head needle plate portions 7 further have recesses 35 and 36 provided therein for accommodating transfer blades 33 and 34 of the upper and lower needles 25 and 29.

Guide projectors 37 and 38 for engaging with a yarn holding member 110 which will be hereinafter described to control the direction of a sliding movement of the yarn holding member 110 are provided at upper and lower portions of a top end portion of each of the sinker accommodating stepped portions 30 while a projector 39 serving as a supporting point for a sinker spring 108 which will be hereinafter described is provided at a lower edge of a mid portion of the sinker accommodating stepped portion 30. The guide projector 37 has a portion 37L having a height corresponding to a thickness of a sinker 100 and another portion 37H having a height corresponding to a total thickness of a sinker 100 and a yarn holding member 110, and the projector 37L guides the sinker 100 while the guide projector 37H guides the yarn holding member 110.

The yarn holding member accommodating stepped portion 31 has a height equal to that of the guide projector 37L, and a side face of a sinker 100 accommodated in the sinker accommodating stepped portion 30 and the yarn holding member accommodating stepped portion 31 lie on a same imaginary plane and the yarn holding member 110 is placed in a layered condition with the sinker 100 and the yarn holding member accommodating stepped portion 31. Reference 40 denotes a wire threading hole, and 41 a metal belt fitting groove.

Each of the sinkers 100 is formed from a plate-like member and includes a sinker body 103 having a hook portion 101 for holding a sinker loop at a free end thereof and a controlling butt 102 at an upper face thereof such that it has an arcuate side shape, and a depending arm 105 extending downwardly in a J-shape from the sinker body 103 and serving as a center of rocking motion. A slit 107 for receiving and securing a sinker spring 108 is provided on the sinker body 103 in the proximity of a base portion of the depending arm 105. The sinker spring 108 is formed from a wire spring curved in a U-shape and has an equal thickness to that of the sinker 100. The sinker spring 108 is held at one end thereof in the slit 107 and is held in contact at the other end portion 109 thereof with the projector 39 provided at the sinker accommodating stepped portion 30 of the head needle plate portion 7.

Each of the yarn holding member 110 is in the form of an elongated member formed from a plate and has a body shank portion 111. A thin head portion 113 which forms an operating edge 112 which defines a downward moderate concave curved line is provided at a free end of the body shank portion 111: a sliding resistance providing portion 114 extending in the same direction as and integrated with the body shank portion 111 and having an upward resilient force is provided at an upper portion of the body shank portion 111: downwardly directed cam edges 115, 115 are provided at both of upper and lower edges of the body shank portion between the sliding resistance providing portion 114 and the thin head portion 113; a recessed portion 116 is provided at a central lower portion of the body shank portion 111: and advancing and retreating movement control means 117 for controlling forward and backward movements of the yarn holding member 110 toward and from a knock-over edge portion 90 is provided at an end portion of a tail portion of the body shank portion 111.

In the embodiment described below, it is described in a form in which a butt is used for the advancing and retreating movement control means 117. The advancing and retreating movement control means 117 of the yarn holding member 110 is provided to advance or retract the yarn holding member 110 toward or from the knock-over edge portion 90 in the yarn holding member accommodating stepped portion 31, and in the example shown, it is shown as a butt which projects from an upper portion of the body shank portion 111. However, the advancing and retreating movement control means 117 is not limited particularly only if it is means provided at a tail portion of each needle bed and capable of advancing and retracting the yarn holding member 110.

In each of the sinkers 100, the sinker body 103 is positioned at the sinker accommodating stepped portion 30 of the head needle plate portion 7 and the depending arm 105 is fitted with the sinker supporting stepped portion 31 of the head needle plate portion 7 while the hook portion 101 projects from between the guide projectors 37L and 38 of the stepped portion 30 toward the knock-over edge portion 90. An end portion 109 of the sinker spring 108 is anchored at the projector 39 of the stepped portions 30 so that the sinker 100 is normally urged so as to project the hook portion 101 toward the knock-over edge portion 90.

The yarn holding member 110 contacts, in a condition wherein it closely contacts with the sinker 100 and contacts at a tail portion thereof with the yarn holding member accommodating stepped portion 31 while it is held at upper and lower portions of the body shank portion 111 by the two guide projectors 37H and 38 and is covered at a side face thereof with an upper spacer 43, at the sliding resistance providing portion 114 thereof with a metal belt 42 fitted in a metal belt inserting groove 41 so that letting off of the yarn holding member 110 is prevented and a sliding resistance is applied to the yarn holding member 110 to prevent an inadvertent movement of the yarn holding member 110. When the yarn holding member 110 is slidably moved forwardly, the guide projectors 37H and 38 and the downwardly directed cam edges 115, 115 are contacted with each other to move the end portion 113 of the yarn holding member 110 downwardly. In addition to the embodiment described above wherein yarn holding member deflection means 140 is formed from the downwardly directed cam edges 115 of the yarn holding member 110 and the guide projectors 37H and 38, it is also possible to provide a resiliency providing member not shown like the sliding resistance providing portion 114 at an upper or lower portion of the body shank portion 111 of the yarn holding member 110 to urge the yarn holding member 110 so that the head portion 113 is pivoted downwardly or upwardly while, though not shown, a guide member for engaging with an upper edge or a lower edge of the body shank portion 111 is provided in an advancing sliding locus of the body shank portion 111 so that, when the yarn holding member 110 is slidably moved forwardly, the head portion 113 of the body shank portion 111 is directed downwardly.

A lower edge 44 of the upper spacer 43 serves as a guide edge for the upper needle 25, and the upper needle 25 is held between the upper spacer 43 and an oblique edge 46 of a lower spacer 45 of a triangular shape at the head needle plate portion 7. The lower spacer 45 is secured to the head needle plate portion 7 by a wire 47 threaded in wire threading hole 49. A lower edge 48 of the lower spacer 45 serves as a guide edge for the lower needle 29. The controlling butt 102 of the sinker 100 and the advancing and retreating movement control means 117 of the yarn holding member 110 are slidably moved by a sinker control cam 51 and a yarn holding member control cam 52 provided on a carriage 50UB which moves on the upper back needle bed UB, respectively. When the the controlling butt 102 of the sinkers 100 is engaged by the sinker control cam 51 provided on the carriage 50UB and moved against the urging force of the spring 108, the hook portion 101 at the free end of the sinker 100 is moved upwardly. However, in the present invention, operation and effects of the hook portion 101 are not described in detail. Reference numerals 53 and 58 denote a needle control lock and a slider control cam provided on the carriage 50UB, respectively.

Figure 11:
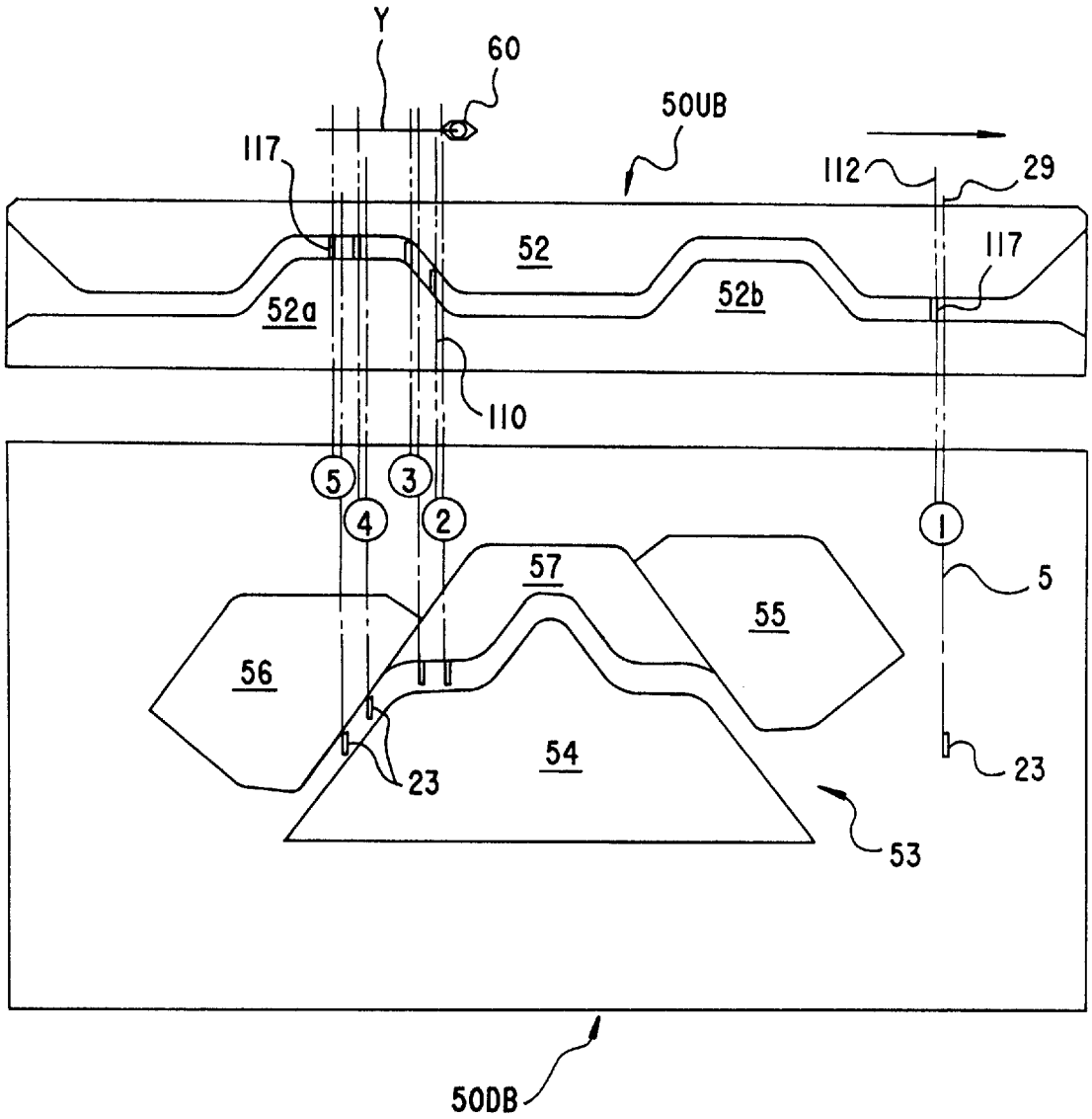
FIG. 11 is an arrangement view showing a positional relationship between a needle control cam and a yarn holding control cam.

FIG. 11 shows an arrangement of the yarn holding member control cam 52 provided on the upper back carriage 5OUB and the needle control lock 53 provided on a lower back carriage 50DB. The needle control lock 53 includes a raising cam 54, knitting cams 55 and 56 provided on the opposite sides of the raising cam 54, and a guide cam 57 provided adjacent a top portion of the raising cam 54. The raising cam 54 has stepped portions at shoulder portions thereof. While each of the shouldered portions acts as a stationary position for allowing a yarn to be supplied stably to the needle, the shouldered portions need not necessarily be required, and if the raising cam 54 is formed in a triangular shape having no such portions, then the carriage can be formed more compact. The yarn holding member control cam 52 and the needle control lock 53 are moved back and forth keeping a phase thereof with the center lines thereof held in register with each other.

Operation of the yarn guiding apparatus of the present invention is described below in connection with an example wherein the lower needles 5 of the lower back bed DB are moved upwardly and downwardly and the yarn holding members 110 of the upper back needle bed UB are operated in response to the upward and downward movements of the lower needles 5.

Description is given of a case wherein a yarn Y is guided to a hook 29 of each lower needle 5.

When to guide the yarn Y to the hook 29 of a lower needle 5, a cam section 52*a* of the yarn holding member control cam 52 which is positioned on the trailing side in an advancing direction of the carriages 50UB and 50DB indicated by an arrow mark in FIG. 11. As the carriages 50 move rightwardly, the advancing and retreating movement control means 117 is caught by the yarn holding member control cam 52, but the control means 117 keeps its most retracted position.

Figure 6:
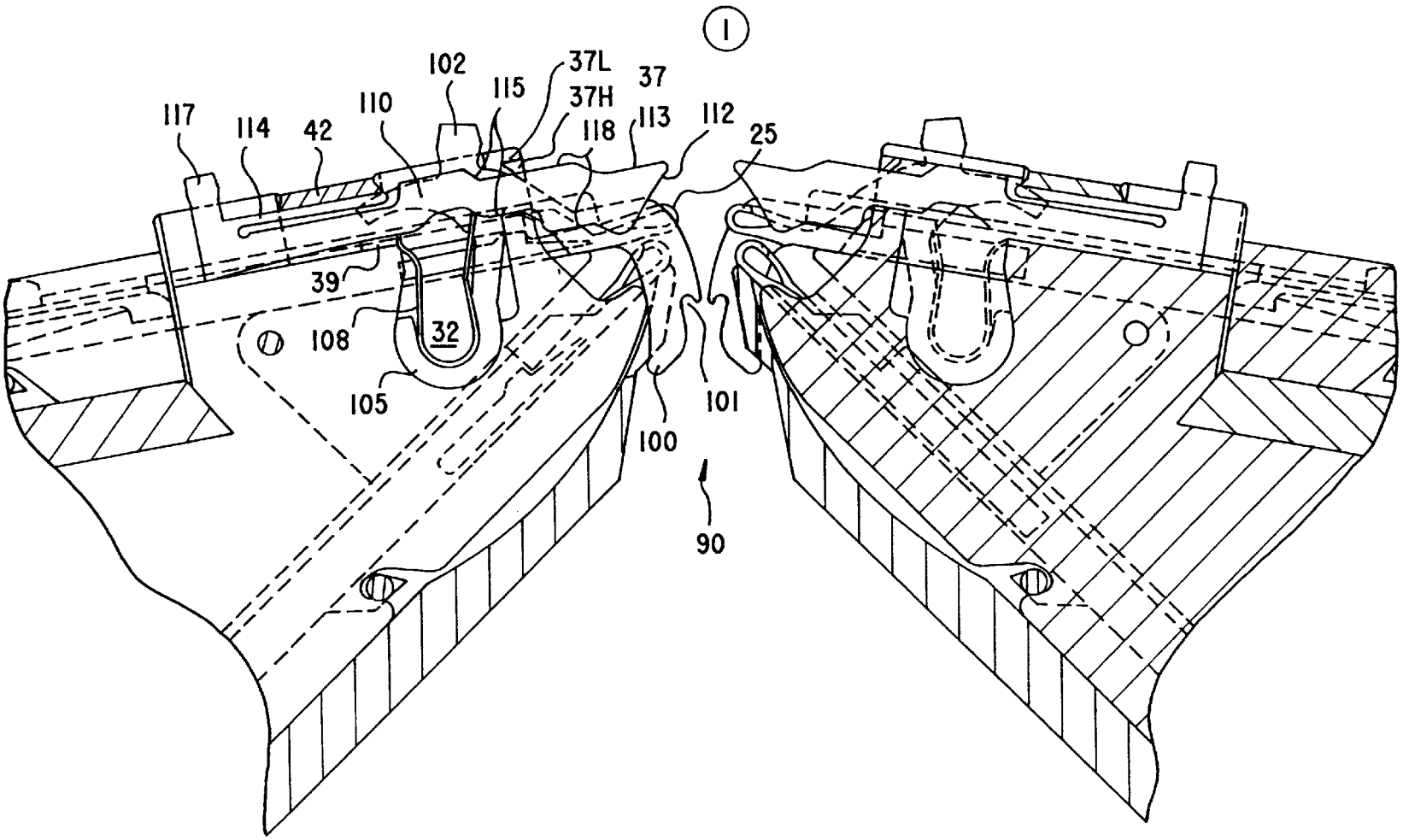
FIG. 6 is a vertical sectional side elevational view of knock-over edge portions when the needles are at their rest position and yarn holding members are retracted.
Figure 7:
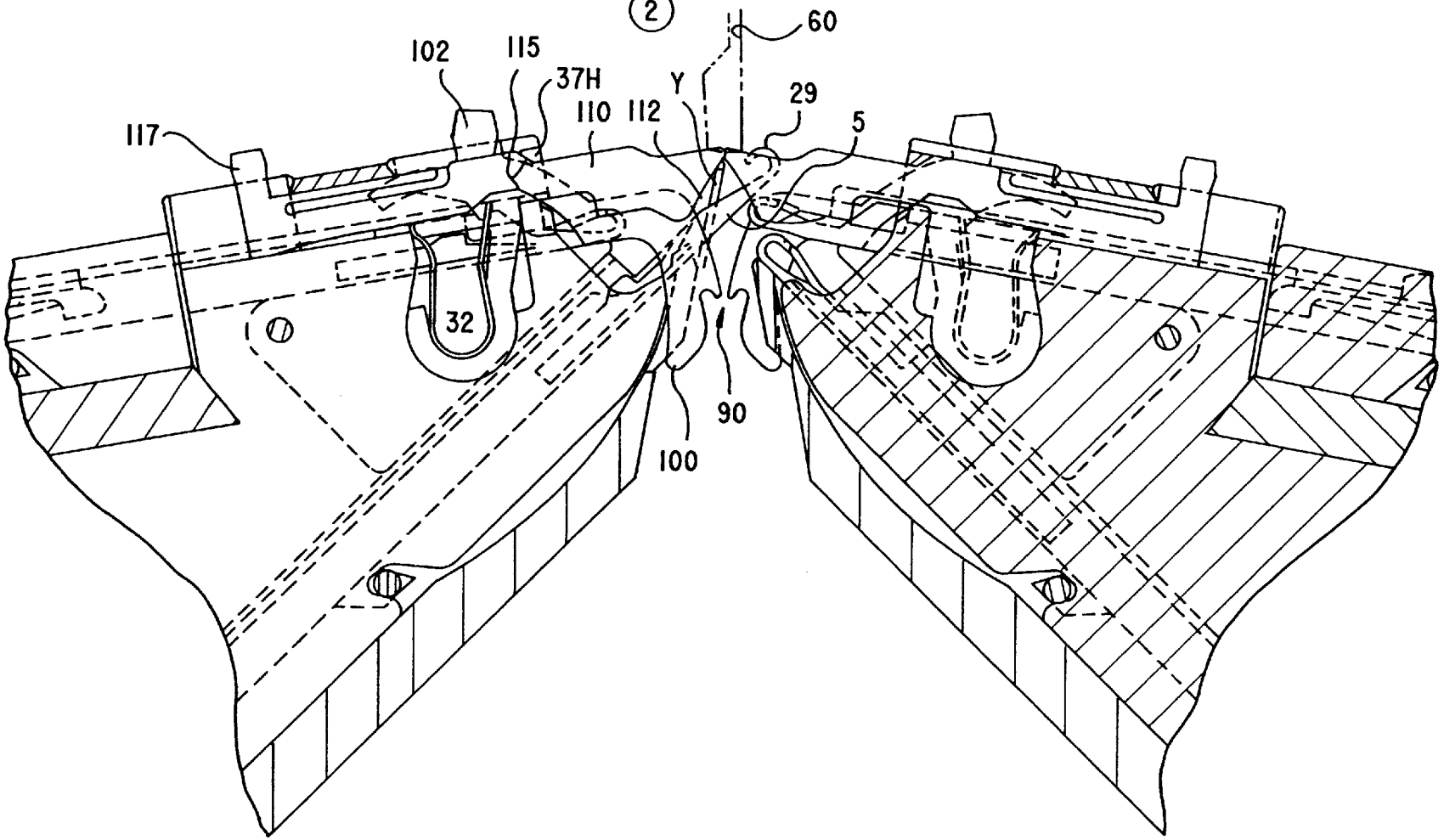
FIG. 7 is a vertical sectional side elevational view of knock-over edge portions in a condition wherein the needles are at the heights of the shoulders of the raising cams and the yarn holding members are advanced to the positions of guide projectors.

A needle butt 23 does not contact with the needle control lock 53 and does not start its upward movement for formation of a knit fabric ① of FIGS. 6 and 11). As the carriages 50UB and 50DB move rightwardly, the needle butt 23 passes by the top portion of the raising cam 54 and is then retracted by the guide cam 57, and when also the hook 29 is lowered from its uppermost position, the advancing and retreating movement control means 117 of the yarn holding member 110 starts its upward movement by the trailing side cam section 52*a* of the yarn holding member control cam 52 (② of FIGS. 7 and 11). Consequently. the yarn holding member 110 advances the operating edge 112 on the opposite sides of the yarn at the knock-over edge portion 90. In this instance, the yarn holding member 110 approaches the hook 29 of the lower needle 5 in a condition wherein upper and lower horizontal edge portions 118, 118 near to the head portion 113 are held between the guide projectors 37H and 38 at the top portion of the head needle plate portion 7.

Figure 8:
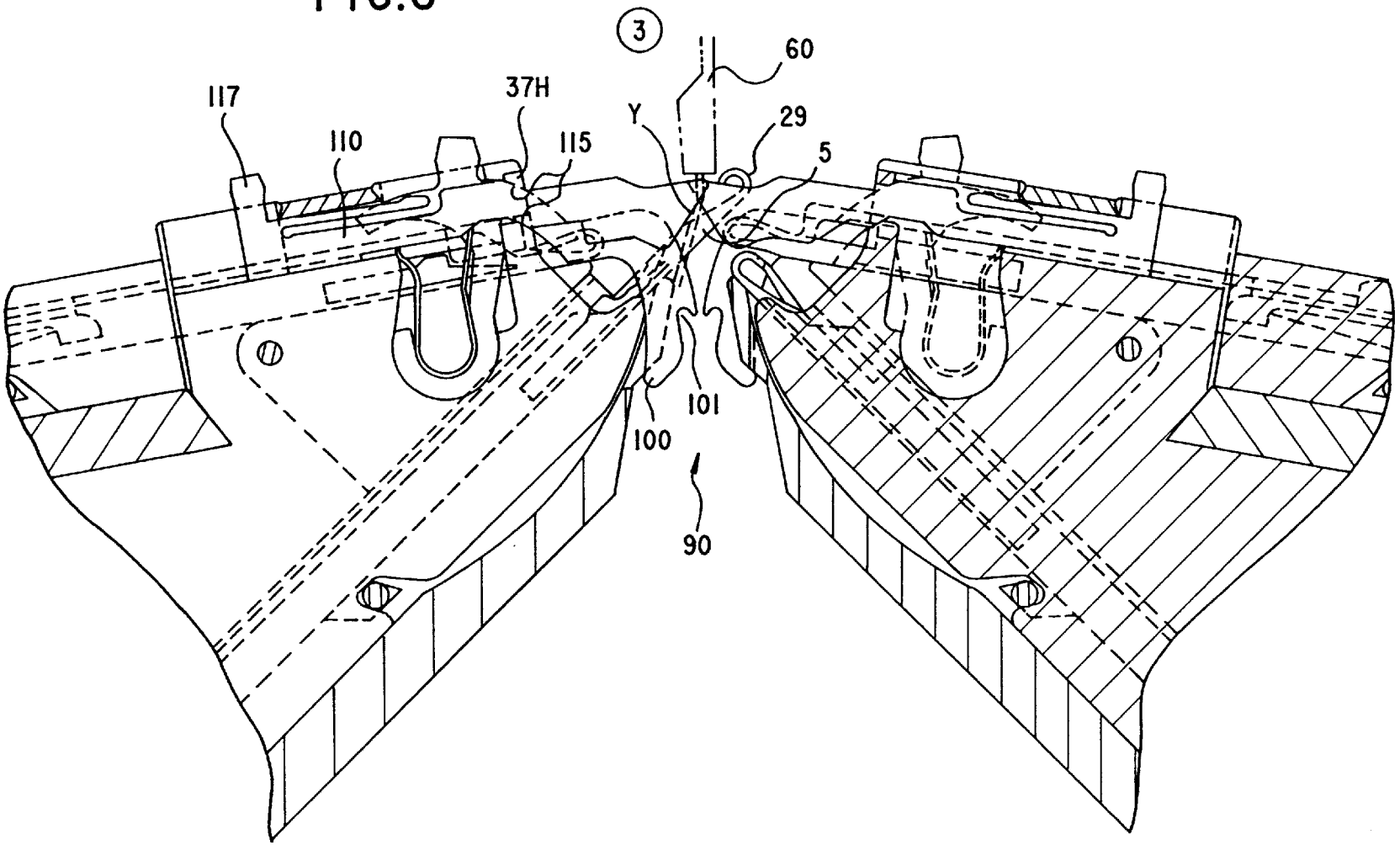
FIG. 8 is a vertical sectional side elevational view of knock-over edge portions in a condition wherein the needles are at the heights of the shoulders of the raising cams and the yarn holding members contact with the guide projectors to start downward rocking movements of free end operating edges thereof.

By a succeeding rightward movement of the carriages 50, the yarn holding member advancing and retreating movement control means 117 is raised along the cam section 52*a* to the top portion of the same to advance the yarn holding member 110. However, immediately before the yarn holding member 110 reaches its highest position, the contact between the horizontal edge portions 118, 118 of the yarn holding member 110 and the projectors 37H and 38 comes to an end and the projectors 37H and 38 are engaged with the downwardly directed cam edges 115, 115 of the yarn holding member 110 (③ of FIGS. 8 and 11). In this instance, while the hook 29 is at the same height position as the position ② described above, only the operating edge 112 of the yarn holding member 110 approaches the hook a little and is engaged with the yarn Y from a yarn carrier 60.

As the carriages 50UB and 50DB are further moved rightwardly, the advancing and retreating movement control means 117 reaches the highest position of the cam section 52*a* to advance the yarn holding member 110 most. Thereupon, the upper and lower downwardly directed cam edges 115, 115 of the yarn holding member 110 are engaged with the guide projectors 37H and 38 to change the direction of the movement of the head portion 113 to the downward direction.

Figure 9:
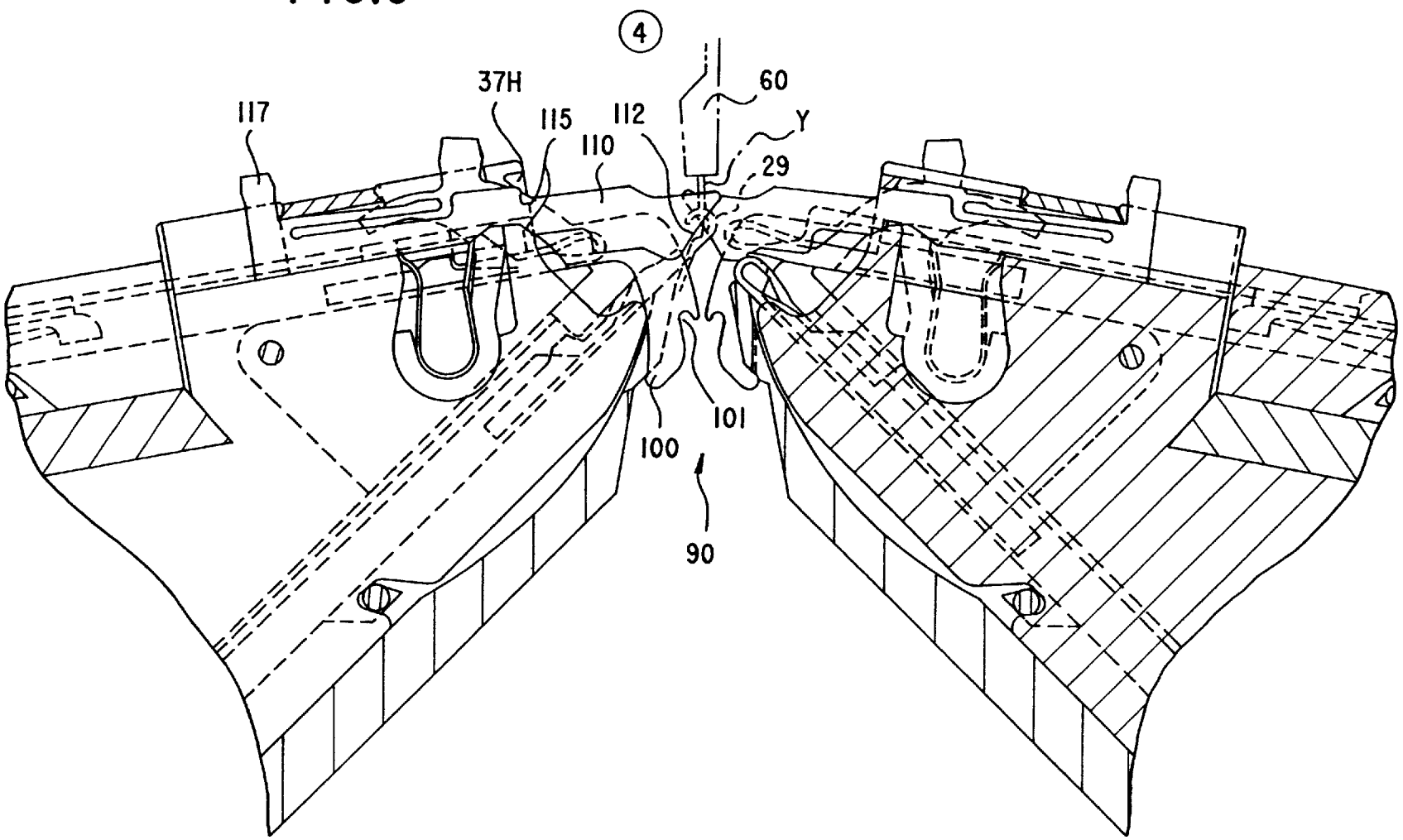
FIG. 9 is a vertical sectional side elevational view of knock-over edge portions in a condition wherein the yarn holding members are advanced most with the operating edges thereof moved down most and a yarn is caught by a hook of the needle.

Simultaneously, the needle control butt 23 is retracted by the knitting cam 56 and also the hook 29 begins a downward movement, but by the downward movement of the yarn holding member head portion 113, the operating edge 112 catches and scratches down the yarn Y. Since the operating edge 112 is in a shape of a centrally recessed concave curve, the yarn Y is caught well and guided to the hook 29 by the operating edge 112 (④ of FIGS. 9 and 11).

Figure 10:
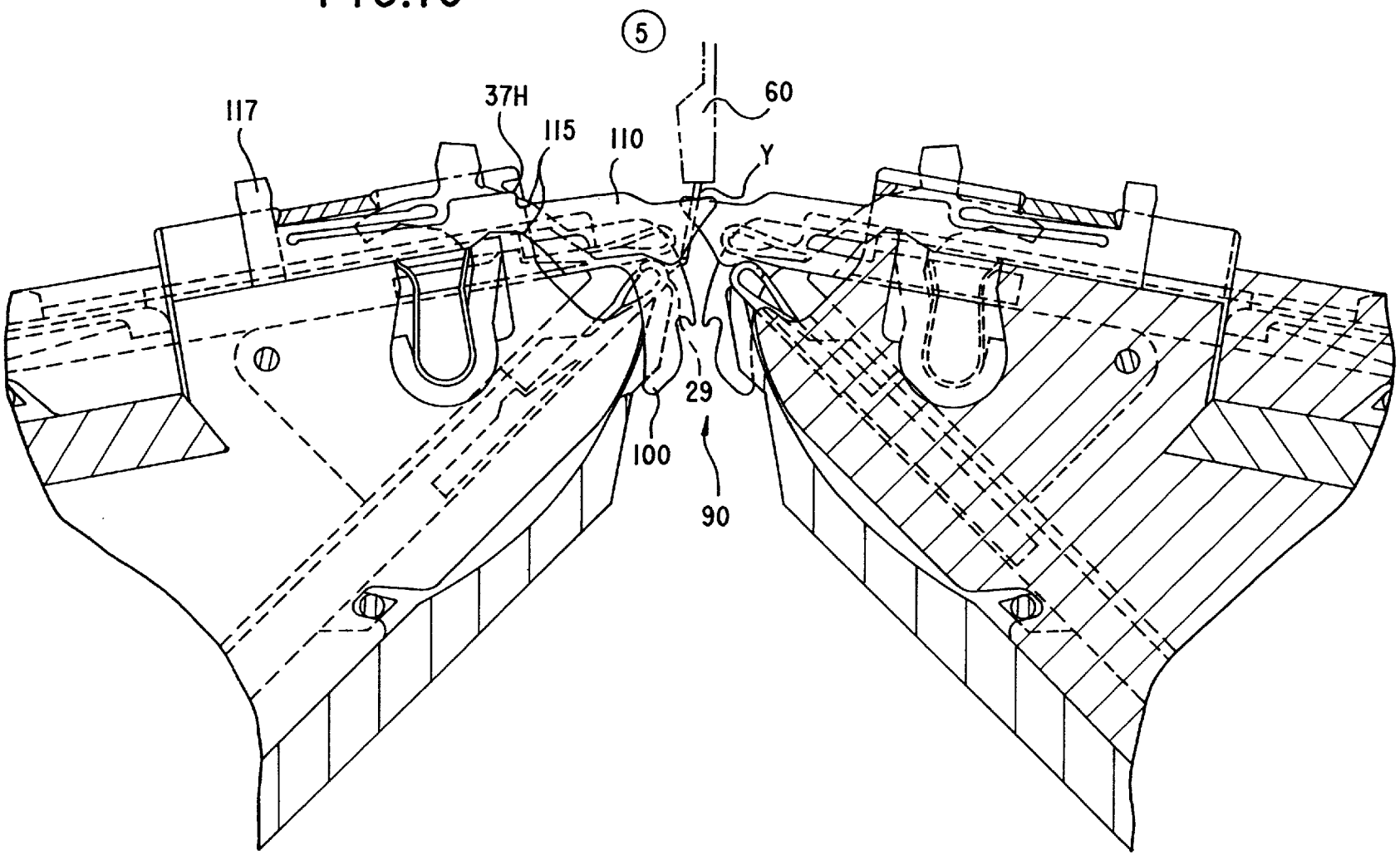
FIG. 10 is a vertical sectional side elevational view of knock-over edge portions in a condition wherein the yarn holding members are advanced most with the operating edges thereof moved down the most and the needles are retracted further.

As the succeeding rightward movement of the carriages 50UB and 50DB continues, while the yarn holding member advancing and retreating movement control means 117 is positioned at the top portion of the cam section 52*a* and remains in the most advanced condition, the needle butt 23 is retracted by the knitting cam 56 and also the hook 29 of the lower needle 5 catches the yarn Y and is retracted (⑤ of FIGS. 10 and 11)

As the carriages 50UB and 50DB further advance the needle butt 23 is retracted most and starts its relative horizontal movement, and in a timed relationship with this, also the yarn holding member advancing and retreating movement control means 117 moves down along the cam section 52*a* and is retracted most, thereby ending one yarn supplying operation. While, in the example described above, a yarn supply operation to the needles of the lower back needle bed DB, naturally a yarn supplying operation to the needles of the upper needle bed UB can be performed in a quite similar manner.

If the carriages 50UB and 50DB are reversed subsequently to the construction described above, then the operation described above is performed using a cam section 52*b* now on the trailing side. It is to be noted that, whether the carriages move rightwardly or leftwardly, when a yarn is to be supplied to needle hooks, since the trailing side cam member is used, where the two cam members are of the fixed type, the leading side cam member merely causes the yarn holding members to perform unnecessary advancing and retreating movements, and therefore, the cam members may be formed as movable cams so that, when any of them is not used, the cam member not used can be retracted to its inoperative position.

When a yarn is to be guided to the rear face of each needle, the cam section of the yarn holding member control cam which is positioned on the leading side in the advancing direction of the carriages is used such that the yarn pushing down operating edge of each yarn holding member is caused to act upon a yarn supplied to the hook by the cam member to push the yarn to a position on the rear face of the needle. In this instance, however, if the yarn pushing down operating edge does not present a larger advancing amount than that when it guides a yarn to the hook of the needle, it cannot push the yarn to the rear face of the needle. To this end, the height of the cam section of the yarn holding member control cam must be set high. However, if the height of the cam member is set excessively high, then when it guides a yarn to the needle hook, it forces the yarn excessively between adjacent needles, and the thus guided yarn does not exhibit a substantially linear condition but is bent in a zigzag condition between the hooks and the yarn pushing down operating edges. As a result, unnecessary tension is applied to the yarn. Therefore, where fixed cam members are used, the height of them is set to an intermediate height between the two heights so that there is no trouble in either case. However, it is desirable that the height of the top of each of the cam members be variable.

Figure 12:
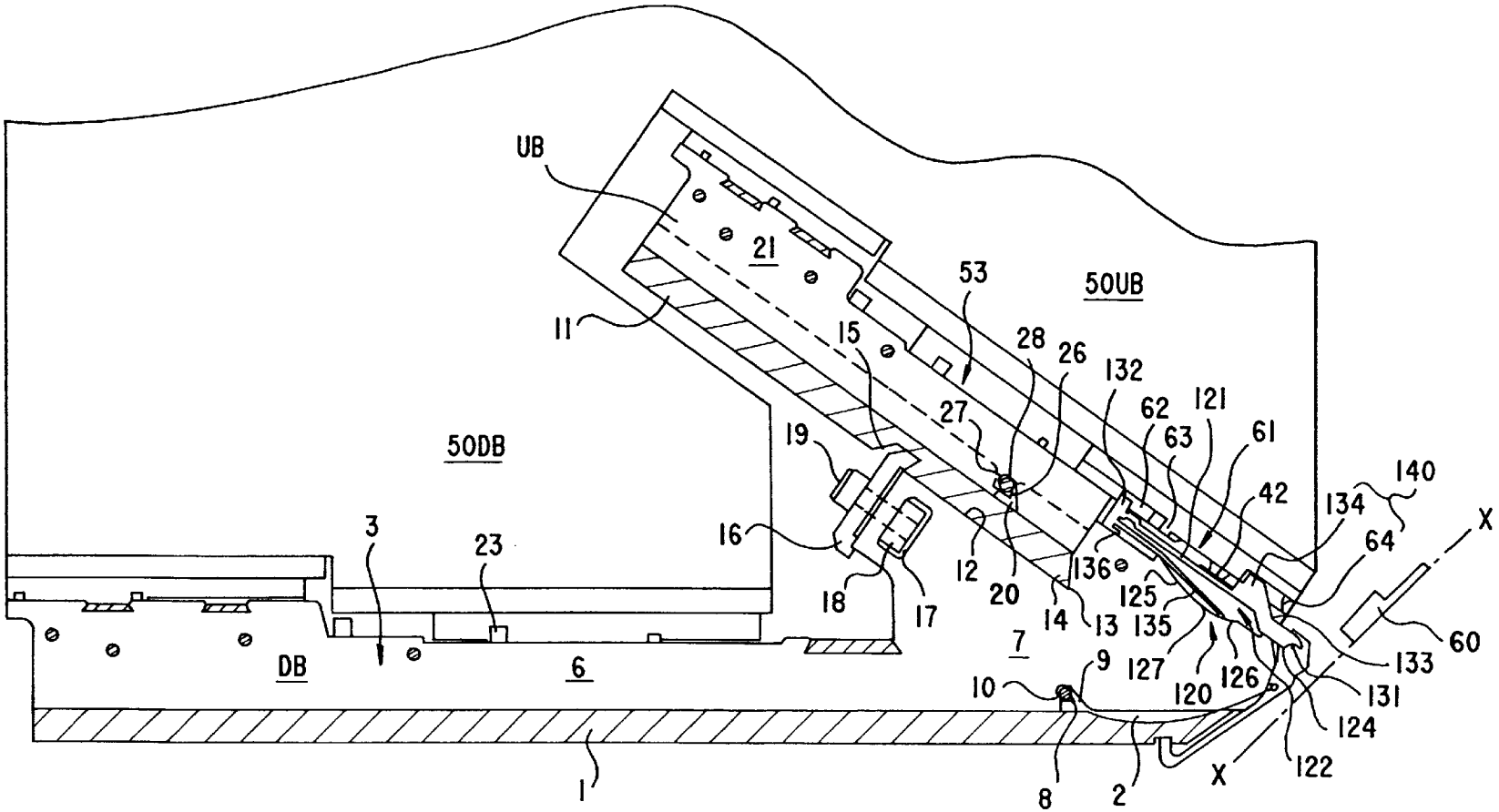
FIG. 12 is a section of upper and lower back beds UB and DB with upper and lower front beds UF and DF on the right side of a knock-over edge center line X—X omitted.
Figure 13:
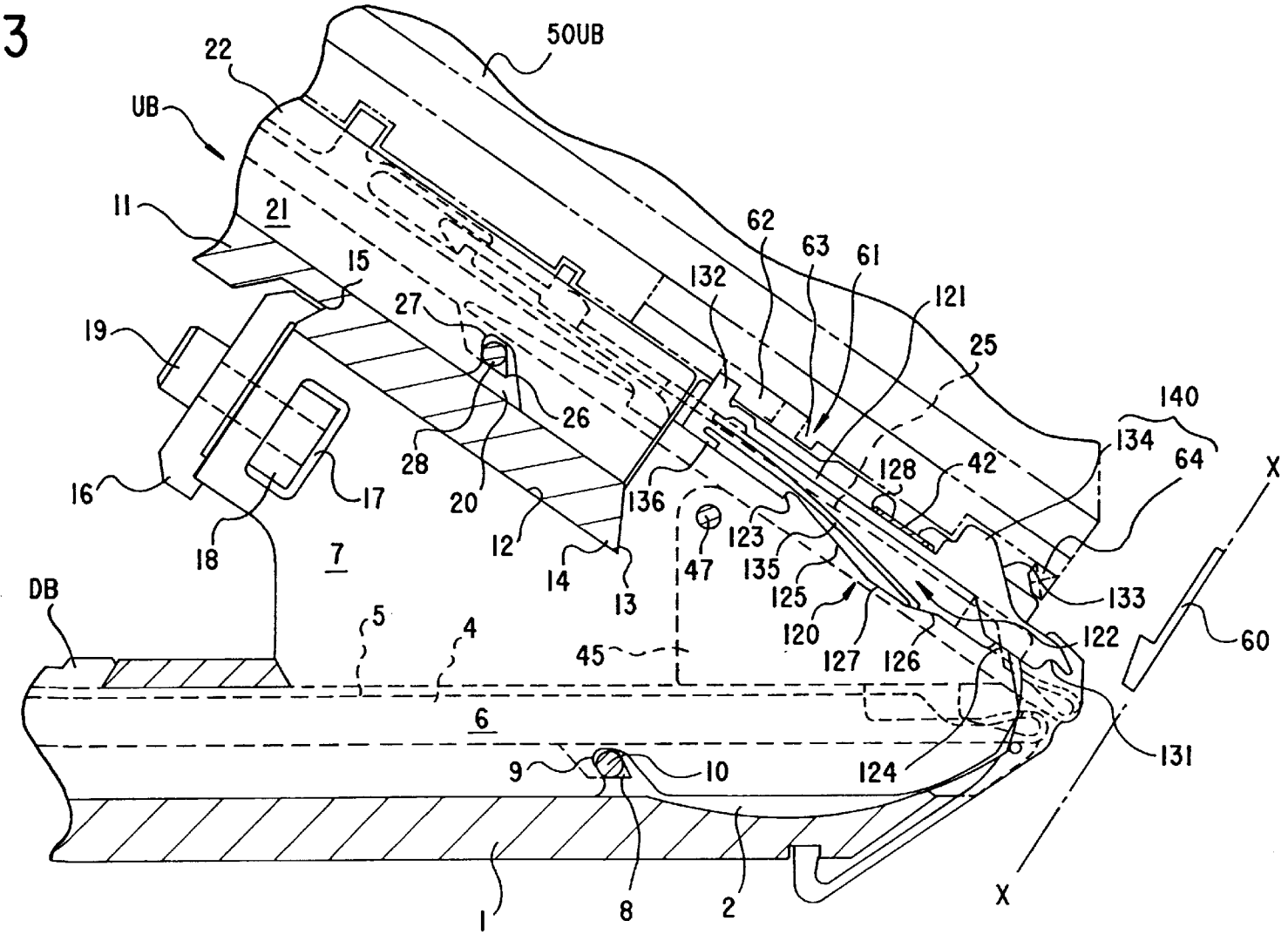
FIG. 13 is an enlarged view of head portions of FIG. 12.
Figure 14:
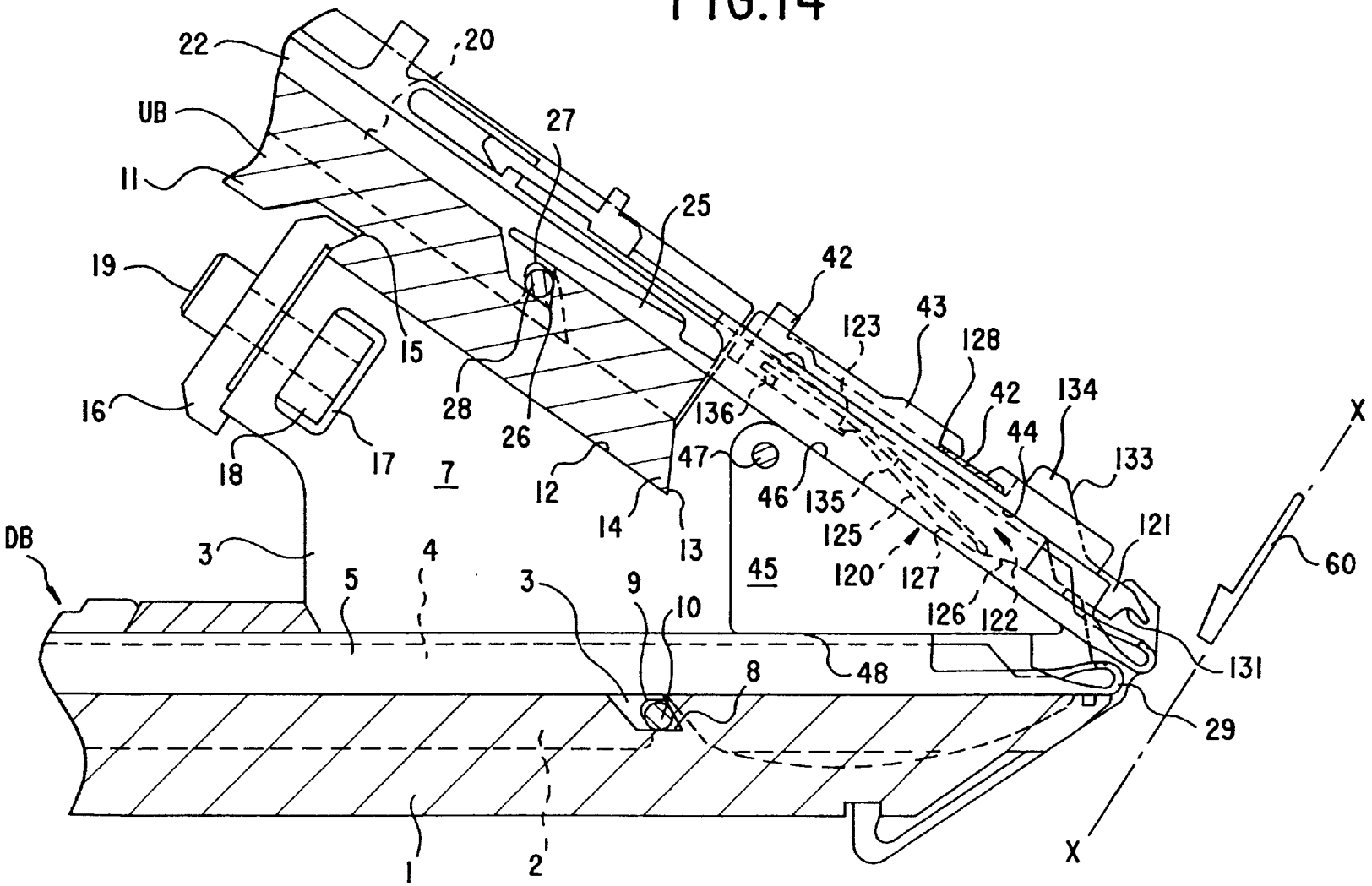
FIG. 14 is an enlarged sectional view of the head portions A, B, C, D and E a second embodiment of the inventions of FIG. 15 are side elevational views of a lower needle plate, an upper needle plate, a yarn holding member, a sinker and an upper spacer, respectively of the embodiment of FIG. 14.

A second embodiment of the present invention is described below in connection with a four-bed flat knitting machine wherein, above front and back lower beds DF (not shown) and DB having head portions provided in an opposing relationship to each other like a mountain with respect to a center line of symmetry provided by a knock-over edge center line X—X, front and back upper beds UF (not shown) and UB provided with head portions thereof opposed to each other like a mountain are provided in an overlapping relationship. FIGS. 12 to 14 show sections of the upper and lower back beds UB and DB with the upper and lower front beds UF and DF on the right side of the knock-over edge center line X—X omitted. FIG. 13 shows an enlarged view of the head portions of FIG. 12, and FIG. 14 shows an enlarged section of different locations of the head portions.

The construction of the front and back upper and lower beds FU, FD and BU, BD in the second embodiment of the present invention is different from that of the first embodiment only in supporting means of yarn holding members 121 and sinkers 150, and description of elements of the same construction as that of the first embodiment is omitted while only differences are described below.

At a top portion of the head needle plate portion 7 of each of the lower needle plates 3, a yarn holding member accommodating portion 122 on which a stepped portion 120 extending in advancing and retreating directions of an upper needle 25 fitted for sliding moment in a needle trick 22 is formed and in which a yarn holding member 121 which will be hereinafter described is accommodated is provided.

The stepped portion 120 of the yarn holding member accommodating portion 122 forms a yarn holding member braking recessed fitting portion 127 composed of stopping projections 123 and 124 for defining a maximum movement amount of a sliding movement of the yarn holding member 121, which will hereinafter described in detail, in a direction the same as the advancing (upward) direction of the upper needle 25 and inclined faces 125 and 126 positioned intermediately between the stopping projections 123 and 124. Reference numeral 128 denotes a metal belt fitting groove in which the metal belt 42 is threaded.

The yarn holding member 121 is an elongated member formed from a plate-like body as shown in C of FIG. 15 and includes a body shank portion 130. A yarn pushing down operating edge 131 opened a little downwardly is provided at the free end of the body shank portion 130: advancing and retreating movement control means 132 for controlling the advancing and retreating movements of the yarn holding member 121 toward and from the knock-over edge portion 90 is provided at a tail position of an upper edge of the body shank portion: and downward movement control means 134 having an inclined face 133 is provided between the yarn pushing down operating edge 131 and the advancing and retreating movement control means 132.

The advancing and retreating movement control means 132 of the yarn holding member 121 is provided to advance or retract the yarn holding member 121 toward or from the knock-over edge portion 90 in the yarn holding member accommodating portion 122, and in the example shown, it is shown as a butt projecting upwardly from an upper portion of the body shank portion 130. However, the advancing and retreating movement control means 132 is not particularly limited if it is means provided at a needle bed tail portion or some other location for advancing or retracting the body shank portion 130.

Meanwhile, the downward movement control means 134 of the yarn holding member 121 is provided to push down the yarn pushing down operating edge 131 at the head portion of the yarn holding member 121, advanced in the yarn holding member accommodating portion 122, downwardly, and in the example shown, it is shown as a butt projecting upwardly from an upper portion of the body shank portion 130. At a lower portion of the body shank portion 130, a resilient member 135 at a rail portion of the body shank portion 130 and a lug 136 which serves as a fulcrum of rocking motion of the yarn holding member are provided so that the yarn pushing down operating edge 131 may be pivoted in an upwardly rising direction. The resilient member 135 need not be formed integrally with the body shank portion 130 as in the present embodiment, and, for example, it can be provided as a separate member between the yarn holding member accommodating portion and the yarn holding member. In summary, a member in the form of a leaf spring may be attached to the body shank portion 130 if it resiliently urges the body shank portion 130 so that the yarn pushing down operating edge may be held at a raised position.

In the embodiment described below, description is given of a form wherein a butt is used for both of the advancing and retreating movement control means 132 and the downward movement control means 134.

In the example shown, the resilient member 135 is formed as a leg provided at a tail portion of the body shank portion 130, and the leg extends in a downwardly directed arc to a position below the downward movement control means 134 and contacts at a free end thereof with the stepped portion 120 of the yarn holding member accommodating portion 122 to urge the yarn pushing down operating edge 131 to pivot upwardly. In the example shown, since the free end of the resilient member 135 contacts with an inclined face 126 of the stepped portion 120 when the yarn holding member 121 is in its most retracted position, the movement of the yarn holding member 121 first receives a low sliding resistance, but as the advancement amount increases, the sliding resistance increases and prevents the yarn holding member 121 from making inadvertent motion less likely. When the yarn holding member 121 is advanced by a maximum amount, the resilient member 135 is contacted with a stepped portion 124 and the movement thereof is stopped. The upper spacer 43 is secured by the metal belt 42 such that it is positioned on the side face of the yarn holding member 121 placed in the yarn holding member accommodating portion 122 and in contact with upper edge of the upper needle 25. The metal belt 42 prevents letting off also of the yarn holding member 121.

The lower edge 44 of the upper spacer 43 (shown in FIG. 14) serves as a guide edge for the upper needle 25, and the upper needle 25 is held between the upper spacer 43 at the head needle plate portion 7 and the oblique edge 46 of the lower spacer 45 of a triangular shape provided on the side face of the head needle plate portion 7.

Also in the second embodiment, similarly as in the first embodiment, an example wherein, when the lower needle 29 of the lower back bed DB is to be raised and lowered, the yarn holding member 121 of the upper back needle bed UB acts is described.

Figure 16:
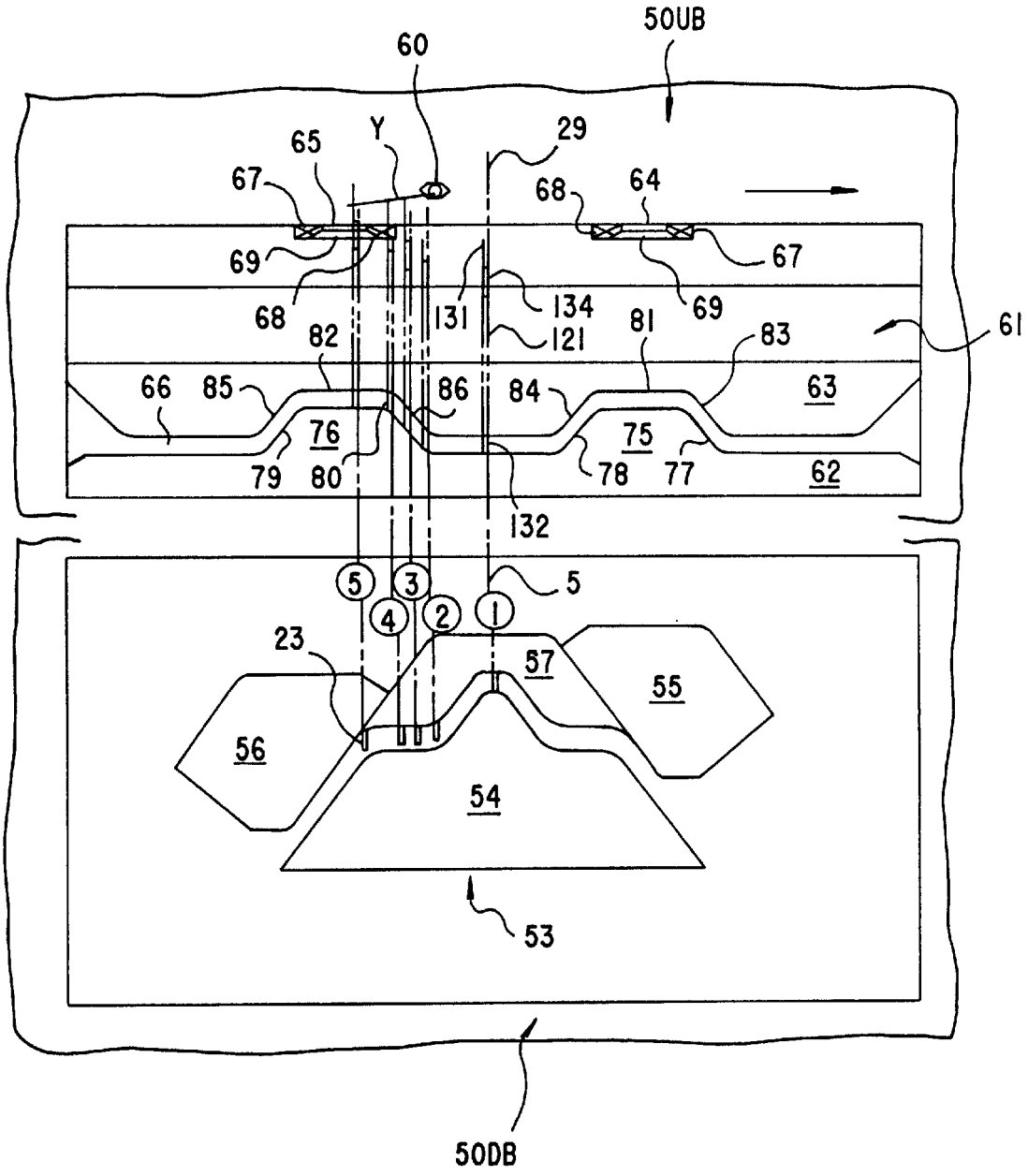
FIG. 16 is an arrangement view illustrating a positional relationship of a needle control cam and a yarn holding control cam and an operation condition of guiding a yarn into hooks of a needle and a yarn holding member of the embodiment of FIGS. 14 and 15.
Figure 17A:
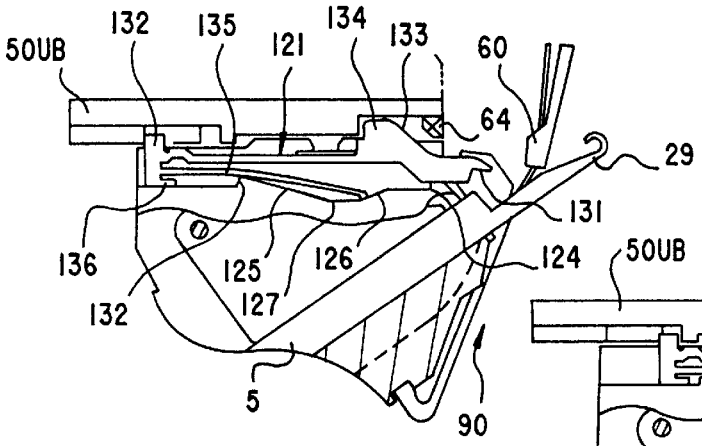
FIG. 17, A to E, are vertical sectional side elevational views illustrating an order of operations in guiding a yarn into a needle hook.
Figure 17D:
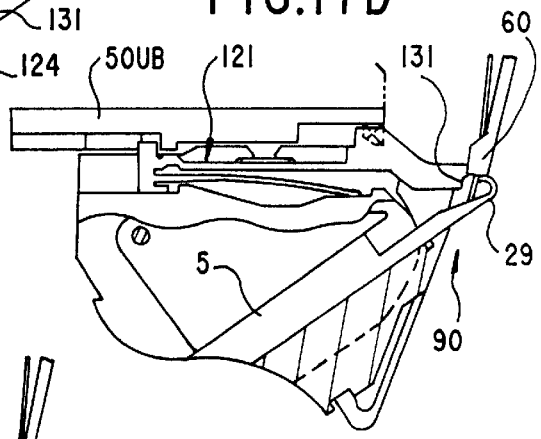
Figure 17B:
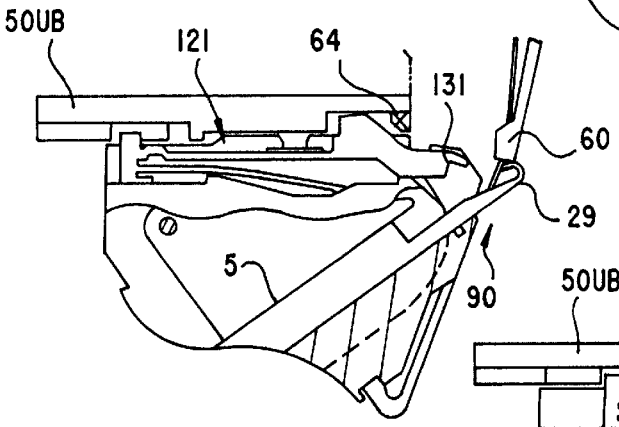
Figure 17E:
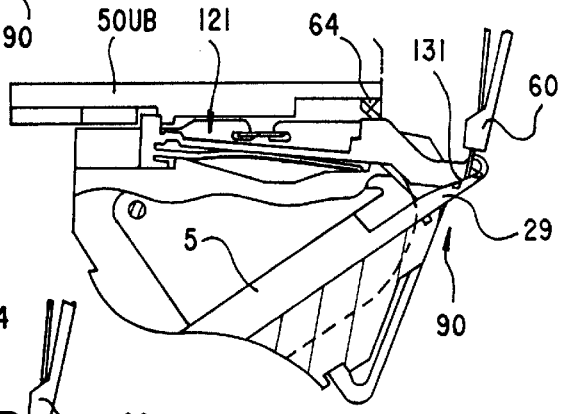
Figure 17C:
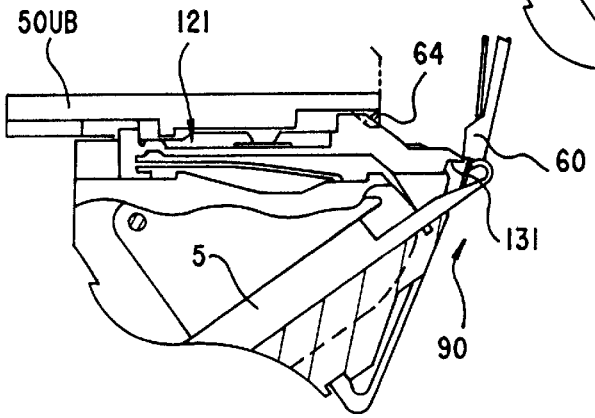

The yarn holding member 121 is operated by a yarn holding member control cam 61 provided on the carriage 50UB which moves on the upper back needle bed UB while the lower needle 5 is operated by a cam lock 53 of the carriage 50DB of the lower back needle bed DB. FIG. 16 illustrates a basic arrangement of cam faces of the yarn holding member control cam 61 of the upper back needle bed UB, engaging conditions of the advancing and retreating movement control butt 132 and downward movement control butt 134 of the yarn holding member 121 (indicated by alternate long and two short dashes lines) with the yarn holding member control cam 61 and engaging conditions of the needle butt 23 of the lower needle 5 (indicated by alternate long and short dash lines) with the needle control lock 53 of the lower back carriage 50DB.

The yarn holding member control cam 61 is composed of a yarn holding member advancing cam 62, a yarn holding member retracting cam 63 and yarn holding member pushing down presser cams 64 and 65, and a passage path 66 for the advancing and retreating movement control means (butts) 132 of the yarn holding member 121 is formed from the yarn holding member advancing cam 62 and the yarn holding member retracting cam 63. The yarn holding member pushing down presser cams 64 and 65 extend long in a carriage advancing direction and have inclined faces 67 and 68 at the opposite ends thereof, respectively, and are rounded at corner portions thereof which contact with the downward movement control means (butt) 134 of the yarn holding member 121 which advances in a direction perpendicular to the longitudinal direction to form inclined faces 69. The downward movement control means 134 of the yarn holding member 121 and the yarn holding member pushing down presser cams 64 and 65 of the yarn holding member control cam 61 construct yarn holding member deflection means 140. The needle control lock 53 includes knitting cams 55 and 56 provided on the opposite sides of the raising cam 54 and a guide cam 57 provided adjacent the top portion of the raising cam 54, and is moved back and forth keeping a phase thereof with the center line thereof registered with that of the yarn holding member control cam 61.

And, as shown in FIG. 16, two cam sections 75 and 76 are formed on the yarn holding member advancing cam 62 at upper phases of stepped portions of the left and right shoulders of the raising cam 54, and inclined faces 77, 78 and 79, 80 on the opposite sides of the cam sections 75 and 76 are provided as raising inclined faces for the advancing and retreating movement control means 132 for advancing the yarn holding member 121 toward the knock-over edge portion. On the yarn holding member retracting cam 63 opposing to the cam sections 75 and 76, concave fitting portions 81 and 82 are formed on the opposite sides of the passage path 66 of the advancing and retreating movement control means 132, and inclined faces 83, 84 and 85, 86 on the opposite sides of the concave fitting portions 81 and 82 are formed as lowering inclined faces for the advancing and retreating movement control means 132 for retracting the yarn holding member 121 from the knock-over edge portion 90. The yarn holding member pushing down presser cam 64 is provided above the cam section 75 and the concave fitting portion 81 while the yarn holding member pushing down presser cam 65 is provided above the cam section 76 and the concave fitting portion 82.

In the second embodiment, such movable sinkers as in the first embodiment are not employed. Conventionally known fixed sinkers 150 are provided at the head portion of the lower needle bed base plate 1.

Operation of the yarn guiding apparatus of the present invention is described below.

FIG. 16 illustrates a relationship between the advancing and retreating movement control means 132 and downward movement control means 134 of the yarn holding member 121 and the yarn holding member control cam 61 when a yarn Y is guided to the hook 29 of the lower needle 5 and a positional relationship between the needle butt 23 of the lower needle 5 and the needle control lock 53.

FIG. 17 illustrates a process of supplying the yarn Y from the yarn carrier 60 into a hook 29 of a lower needle 5.

Description is given of a case wherein the yarn Y is guided to the hook 29 of the lower needle 5.

When the yarn Y is to be guided into the hook 29 of the lower needle 5, the cam section 76 of the yarn holding member advancing cam 62 of the yarn holding member control cam 61 which is positioned on the trailing side in the advancing direction of the carriage 50UB indicated by an arrow mark in FIG. 16 is used. As the carriage 50UB moves rightwardly, the advancing and retreating movement control means 132 of the yarn holding member 121 keeps its position retracted in the passage path 66 of the yarn holding member advancing cam 62.

The needle butt 23 advances the hook 29 most by the raising cam 54 (① of FIG. 16 and A of FIG. 17). As the carriages 50UB and 50DB move rightwardly, the needle butt 23 passes by the top of the raising cam 54 and is retracted by the guide cam 57, and when the hook 29 of the lower needle 5 is lowered to the position of the raising cam 54, the advancing and retreating movement control means 132 of the yarn holding member 12 starts its advancement by the trailing side cam section 76 of the yarn holding member advancing cam 62 (② of FIG. 16 and B of FIG. 17). The yarn holding member 121 having started its advancement advances the yarn pushing down operating edge 131 with respect to the yarn Y at the knock-over edge portion. In this instance, the downward movement control means 134 of the yarn holding member 121 does not contact with the yarn holding member pushing down presser cam 65, and the yarn holding member 121 relatively moves straightforwardly toward the yarn holding member pushing down presser cam 65 (③ of FIG. 16 and C of FIG. 17).

By succeeding rightward movement of the carriages 50UB and 50DB, while the lower needle 5 keeps the hook 29 thereof at the position of a shoulder of the raising cam 54, the yarn pushing down operating edge 131 of the yarn holding member 121 is advanced most since the advancing and retreating movement control means 132 rises to its highest position along the inclined face 86 of the cam section 76, and simultaneously, the inclined face 133 of the downward movement control means 134 is advanced toward the knock-over edge portion. Then, as the carriages 50UB and 50DB move rightwardly, the downward movement control means 134 is engaged with the inclined face 68 of the yarn holding member pushing down presser cam 65 (④ of FIG. 16 and D of FIG. 17), and as the carriages 50UB and 50DB move rightwardly, the downward movement control means 134 is pushed in against the resilient force of the resilient member 135 to pivot the yarn pushing down operating edge 131 at the end of the yarn holding member 121 downwardly (⑤ of FIG. 16 and E of FIG. 17). As the downward movement control means 134 is pushed in, the yarn holding member 121 pivots the yarn pushing down operating edge 131 downwardly against the resilient force of the resilient member 135. In this instance, however, since the resilient member 135 is in contact at the end thereof with the raising inclined face 126 of the yarn holding member braking recessed fitting portion 127, it normally is in a stopping condition without making an inadvertent movement, but as a sliding movement is started, the resilient member 135 is engaged with and moved by the horizontal face following the raising inclined face 126. Consequently, the sliding movement is smooth. On the contrary, when the yarn holding member 121 is retracted, the end of the resilient member 135 is lowered and enters the inclined face 126 from the horizontal portion, and upon retreating movement, the resistance by the resilient force decreases gradually and a smooth retreating movement is obtained.

By the downward pivotal movement of the yarn pushing down operating edge 131, the yarn pushing down operating edge 131 catches the yarn Y supplied from the yarn carrier 60 and guides the yarn Y into the hook 29 of the lower needle 5. The lower needle 5 having the yarn Y guided into the hook 29 thereof is advanced as the needle butt 23 is engaged with the knitting cam 55, and catches the yarn Y in the hook 29 and is retracted from the knock-over edge portion 90.

Upon starting of the retreating movement, since the downward movement control means 134 of the yarn holding member 121 is in engagement with the yarn holding member pushing down presser cam 65, the yarn pushing down operating edge 131 remains in the downwardly pivoted condition. However, as the carriages 50UB and 50DB advance, the downward movement control means 134 is spaced away from the yarn holding member pushing down presser cam 65 and removes its pushing force, the yarn pushing down operating edge 131 is pivoted upwardly to return to its original position.

When the yarn Y is to be guided into the needle hook 29 by the yarn holding member 121 during leftward movement after the movement direction of the carriages 50UB and 50DB is reversed subsequently to the rightward movement of the carriages 50UB and 50DB, the cam section 75 is used conversely to that upon rightward movement, and the inclined face 78 of the cam section 75 and the advancing and retreating movement control means 132 are engaged with each other to advance the yarn holding member 121 toward the knock-over edge portion, and the downward movement control means 134 and the yarn holding member pushing down presser cam 64 are engaged with each other to pivot the yarn pushing down operating edge 131 of the yarn holding member 121 downwardly.

When the yarn Y is to be guided to the rear face of the lower needle 5, this is performed in a similar manner as in the first embodiment. Where the two cam sections are of the fixed type, since one of the cam sections merely causes the yarn holding members to perform unnecessary advancing and retreating movements, the cam members may be formed as movable cams so that, when any of them is not used, the cam member not used can be retracted to its inoperative position.

While, in the embodiment described above, the inclined face 133 is formed on a front edge of the downward movement control means 134, if the advancement of the yarn holding member 121 is delayed from that in the embodiment described above or the timing of engagement with the yarn holding member pushing down presser cam 64 is made different from that in the embodiment so that the inclined face 133 is engaged with the inclined face 69 of the yarn holding member pushing down presser cam 64, then it is possible to cause the yarn pushing down operating edge 131 to draw a locus wherein, in the proximity of an end position of the advancement, it is pivoted downwardly while it is advanced, like the yarn pushing down operating edge 112 of the yarn holding member 110 in the first embodiment.

While the first and second embodiments described above include four beds and includes the yarn holding members 110 and 121 provided on the upper back bed UB of the upper back beds UB and DB, the yarn holding members 110 or 121 may be provided in an opposing relationship to each other on the front and back upper beds or may be provided on only one of the front and back beds. Where two beds are provided, they may be provided on both or only one of the front and back beds. The yarn holding members 110 or 121 need not be provided for the individual needles, but may be provided for every predetermined number of needles. Where 4 beds are provided, they need not be provided on the lower beds, and therefore, the yarn holding member control cam 52 or 61 may be provided on a carriage or carriages for one or both of the front and back upper beds. When to operate the lower needles 5 of the lower back bed DB and simultaneously operate the yarn holding members 110 or 121, the needle control lock 53 of the lower back bed carriage 50DB and the yarn holding member control cam 52 or 61 of the carriage 50UB or 50UF for the upper back or front bed should be used.

Industrial Applicability of the Invention

The yarn guiding apparatus of the present invention is effectively utilized for an inlay knit wherein a floating yarn extending long between a needle and a yarn carrier appears or an intarsia knit wherein a yarn is wrapped around a needle which knits an end loop of a pattern since a yarn can be guided into a hook or to a predetermined position of a rear face of a needle.

What is claimed is:

1. A yarn guiding apparatus for a flat knitting machine having at least one pair of needle beds disposed with head portions thereon opposed to each other and knock-out edge portions positioned centrally therebetween, a plurality of needles provided in rows in said needle beds for sliding movements toward said knock-out edge portions and sinkers disposed between said needles and yarn holding members, said yarn holding members each having an operating edge for pushing down yarn at a free end of said yarn holder and supported in parallel to said needles for sliding movement toward said knock-out edge portions, said yarn holder members having deflection means for deflecting said yarn holder members and said yarn therein downwardly toward said needles in said needle beds for engagement of said yarn with said needles.

2. A yarn guiding apparatus for a flat knitting machine as set forth in claim 1, characterized in that said yarn holding member deflection means are provided on said yarn holding members and said needle beds.

3. A yarn guiding apparatus for a flat knitting machine as set forth in claim 1, characterized in that said yarn holding member deflection means are provided on said yarn holding members.

4. A yarn guiding apparatus for a flat knitting machine as set forth in claim 1, wherein said apparatus comprises yarn holding member deflection means, including means for advancing and retracting said yarn holding members toward and away from said knock-out edge portions and a member for acting to move said yarn holding member downwardly, so that, when said yarn holding member slidably advances, said yarn pushing down separating edge at the end of the yarn holding member is moved downwardly by said advancing movement and projects downwardly.

5. A yarn guiding apparatus for a flat knitting machine as set forth in claim 1, comprising a yarn holding member deflection means for advancing and retracting said yarn holding members toward and away from the knock-out edge portions and a member for acting upon each of said yarn holding members for advancing said yarn holding members to move said yarn operating edge downwardly, and said yarn operating edge is moved downwardly after said yarn holding members are advanced.

6. A yarn guiding apparatus for a flat knitting machine having a yarn guiding apparatus, which guiding apparatus includes at least one pair of needle beds, each of said needle beds having a plurality of needles provided in side-by-side rows for sliding movement and which have head portions provided in an opposing relationship to each other at central portions between knock-over edge portions and yarn holding members each having, at an end thereof, a yarn pushing down operating edge for acting upon a yarn extending from a yarn carrier which travels in a longitudinal direction of said needle beds to push down said yarn at least to a position at which said yarn can be caught by a hook of a needle and supported for advancing and retracting movements in parallel to said needles on said needle beds, wherein on a side of each yarn holding member, advancing and retracting movement control means for advancing and retracting said yarn holding member toward and away from said knock-over edge portions and downward movement control means between said advancing and retracting movement control means and the yarn holding down operating edge for moving said yarn pushing down operating edge downwardly on said yarn holding member, and a resilient member having an end engaged with a supporting face for resiliently urging said yarn pushing down operating edge upwardly so as to be held at a raised position in a condition wherein said yarn holding member is advanced provided on a lower edge of the yarn pushing down member, while, on a carriage side which is moved back and forth on each of said needle beds, a yarn holding member advancing cam at a position opposing to said advancing and retracting movement control means of said yarn holding member for engaging with the advancing and retracting movement control means for advancing said yarn holding members to advance said yarn pushing down operating edges to locations above yarn extending from a yarn supply, a yarn pushing down presser cam for pressing said downward movement control means of any of the yarn holding members which is at an advanced position to move down the yarn pushing down operating edge to push down said yarn at least into a path of passage of a hook to a needle, and a yarn holding member retracting cam for engaging with said advancing and retracting movement control means for retracting said yarn holding members.

7. A yarn guiding apparatus for a flat knitting machine as set forth in claim 6, wherein a resilient member is provided integrally on a lower edge of each of said yarn holding members such that the yarn pushing down operation edge provided at a head portion is pivoted upwardly by the resiliency of said resilient member.

8. A yarn guiding apparatus for a flat knitting machine as set forth in claim 6, wherein each of said yarn holding members is inserted for sliding movement in a yarn holding member accommodating portion formed from a stepped portion provided at a top portion of a needle plate, and said resilient member is engaged with a yarn holding member braking recessed fitting portion at said stepped portion.

* * * * *

UNITED STATES PATENT AND TRADEMARK OFFICE

CERTIFICATE OF CORRECTION

PATENT NO. : 6,014,874
DATED : January 18, 2000
INVENTOR(S) : SHIMA et al.

It is certified that error appears in the above-identified patent and that said Letters Patent is hereby corrected as shown below:

On the title page in item[73], change the assignee, "Shima Seika Mfg., Ltd., Wakayama, Japan", to be --Shima Seiki Mfg., Ltd., Wakayama, Japan--

Signed and Sealed this

Fifth Day of September, 2000

*Attest:*

*Attesting Officer*

Q. TODD DICKINSON

*Director of Patents and Trademarks*